US012178367B1

(12) United States Patent
Chen

(10) Patent No.: US 12,178,367 B1
(45) Date of Patent: Dec. 31, 2024

(54) FOLDABLE BATHTUB

(71) Applicant: Taizhou Tongchuang Maternal and Infant products Co., Ltd., Taizhou (CN)

(72) Inventor: Hui Chen, Taizhou (CN)

( * ) Notice: Subject to any disclaimer, the term of this patent is extended or adjusted under 35 U.S.C. 154(b) by 0 days.

(21) Appl. No.: 18/794,191

(22) Filed: Aug. 5, 2024

(30) Foreign Application Priority Data

Jul. 24, 2024 (CN) ..... 202421765400.7

(51) Int. Cl.
*A47K 3/06* (2006.01)

(52) U.S. Cl.
CPC ..... *A47K 3/06* (2013.01)

(58) Field of Classification Search
CPC ..... A47K 3/06
See application file for complete search history.

(56) References Cited

U.S. PATENT DOCUMENTS

2022/0079390 A1* 3/2022 Pruzhansky ..... A47K 3/024
2023/0270294 A1* 8/2023 Yang ..... A47K 3/06 4/585

FOREIGN PATENT DOCUMENTS

CN 215127782 U * 12/2021

* cited by examiner

*Primary Examiner* — Christine J Skubinna

(57) ABSTRACT

A foldable bathtub includes a first bathtub edge, a second bathtub edge, a bathtub body, and a supporting member. The bathtub body includes an annular side wall and a bathtub bottom arranged at a bottom portion of the annular side wall. The first bathtub edge and the second bathtub edge are both arranged at a top portion of the annular side wall. The bathtub body also includes a first folding part. Two side of the first folding part are respectively connected to the first bathtub edge and the second bathtub edge. The bathtub bottom includes a second folding part. The annular side wall, the first folding part, and the second folding part are made of flexible material. The first bathtub edge is rotationally folded with the second bathtub edge through the first folding part. The bathtub bottom is rotationally folded in half through the second folding part.

20 Claims, 11 Drawing Sheets

FOLDABLE BATHTUB

CROSS-REFERENCE TO RELATED APPLICATIONS

The application claims priority of Chinese patent application CN2024217654007, filed on 2024 Jul. 24, which is incorporated herein by reference in its entireties.

TECHNICAL FIELD

The present invention relates to the technical field of daily necessities, particularly to a foldable bathtub.

BACKGROUND ART

At present, a foldable bathtub generally includes a supporting member, a supporting ring, and a soft rubber bathtub body connected to the supporting ring. When the foldable bathtub is not in use, the soft rubber bathtub can be folded along a direction of the foldable bathtub, thereby reducing the volume in a height direction of the foldable bathtub and facilitating storage. When in use, the soft rubber bathtub extends and opens in the height direction of the foldable bathtub, and the supporting ring is supported by the supporting member, making the soft rubber bathtub suspended for a user to use. However, the foldable bathtub of the structure occupies a large area and is not compact enough, making it inconvenient for the user to carry outside.

SUMMARY

The main purpose of the present invention is to provide a foldable bathtub for solving the problem that the existing foldable bathtub is large and inconvenient for a user to carry.

In order to solve the above technical problem, the following technical solution is provided by the present invention.

A foldable bathtub includes a first bathtub edge, a second bathtub edge, a bathtub body, and a supporting member.

The bathtub body includes an annular side wall and a bathtub bottom. The bathtub bottom is arranged at a bottom portion of the annular side wall. The first bathtub edge and the second bathtub edge are both arranged at a top portion of the annular side wall. The bathtub body also includes a first folding part. Two side of the first folding part are respectively connected to the first bathtub edge and the second bathtub edge. The first folding part is positioned at the top portion of the annular side wall, and the bathtub bottom includes a second folding part. The annular side wall, the first folding part, and the second folding part are made of flexible material. The first bathtub edge is configured to be rotationally folded with the second bathtub edge through the first folding part, and the bathtub bottom is configured to be rotationally folded in half through the second folding part and drive the annular side wall to fold in half.

The supporting member is slidably provided on the first bathtub edge and/or the second bathtub edge. The supporting member is configured for supporting the first folding part from collapsing downward when the foldable bathtub is in a use state.

Furthermore, the supporting member includes a first sliding member and a second sliding member. The first sliding member is slidably arranged on the first bathtub edge, and the second sliding member is slidably arranged on the second bathtub edge. The first sliding member abuts against or is connected to the second sliding member when the foldable bathtub is in the use state.

Furthermore, the first sliding member and the second sliding member are connected in a buckle manner when the foldable bathtub is in the use state.

Furthermore, the first sliding member is provided with a first fixing block at one end close to the second sliding member, and the second sliding member is provided with a first fixing opening at one end close to the first sliding member. The first fixing block is placed inside the first fixing opening when the foldable bathtub is in the use state.

Furthermore, the first sliding member is provided with gaps on both sides of the first fixing block.

Furthermore, the first fixing block includes a connecting segment connected to the first sliding member and a first convex block arranged on the connecting segment. The two gaps are positioned on both sides of the connecting segment.

Furthermore, the connecting segment extends at one end away from the first sliding member to form an unlocking segment, and an anti-slip stripe is provided on the unlocking segment.

Furthermore, a first locking column is provided on the first bathtub edge, and the foldable bathtub further includes a first position limiting block provided on the first locking column. A first strip-shaped hole is defined in the first sliding member, and the first sliding member is positioned between the first position limiting block and the first locking column. The first position limiting block and/or the first locking column are partially placed in the first strip-shaped hole, and a width of the first position limiting block is greater than a width of the first strip-shaped hole.

The second bathtub edge is equipped with a second locking column, and the foldable bathtub also includes a second position limiting block arranged on the second locking column. A second strip-shaped hole is defined in the second sliding member, and the second sliding member is positioned between the second position limiting block and the second locking column. The second position limiting block and/or the second locking column are partially placed in the second strip-shaped hole. A width of the second position limiting block is greater than a width of the second strip-shaped hole.

Furthermore, the first bathtub edge is bent outward to form a first position limiting groove. The first locking column and the first position limiting block are both placed in the first position limiting groove, and the first sliding member is at least partially placed in the first position limiting groove. The second bathtub edge is bent outward to form a second position limiting groove. The second locking column and the second position limiting block are both placed in the second position limiting groove, and the second sliding member is at least partially placed in the second position limiting groove.

Furthermore, the first position limiting groove is provided with a first sliding groove at a position corresponding to the first sliding member, and the second position limiting groove is provided with a second sliding groove at a position corresponding to the second sliding member. A width of the first sliding groove, a width of the second sliding groove, a width of the first sliding member, and a width of the second sliding member all gradually increase in a direction away from the first folding part.

Furthermore, the foldable bathtub further includes a temperature detection module for detecting temperature. The temperature detection module is arranged on the first bathtub edge or the second bathtub edge.

Furthermore, the foldable bathtub further includes a decorative outer housing. The decorative outer housing is arranged on the first bathtub edge and/or the second bathtub edge, and the temperature detection module is arranged on the decorative outer housing.

Furthermore, a plurality of first fixing holes are defined in the first bathtub edge and/or the second bathtub edge, and a plurality of connecting columns are provided at a bottom portion of the decorative outer housing. The connecting columns are provided with second convex blocks. The connecting columns are placed inside the first fixing holes. The second convex blocks are positioned below the first fixing holes.

Furthermore, the decorative outer housing is arranged along the first bathtub edge or the second bathtub edge, and a width of the decorative outer housing is greater than two-thirds of a width of the foldable bathtub. The temperature detection module is arranged at a middle position in a width direction of the foldable bathtub.

Furthermore, the foldable bathtub further includes a first supporting leg rotatably arranged on the first bathtub edge, and the first supporting leg is positioned on one side of the first sliding member away from the second sliding member. The foldable bathtub further includes a second supporting leg rotatably arranged on the second bathtub edge. The second supporting leg is positioned on one side of the second sliding member away from the first sliding member. A bottom portion of the first supporting leg and a bottom portion of the second supporting leg are both positioned below a bottom portion of the bathtub bottom or on an identical plane with the bottom portion of the bathtub bottom when the foldable bathtub is in the use state.

Furthermore, the bathtub bottom further includes a first bottom housing and a second bottom housing both arranged at the bottom portion of the annular side wall. The second folding part is positioned between the first bottom housing and the second bottom housing, and two sides of the second folding part are respectively connected to the first bottom housing and the second bottom housing. The first bottom housing and the second bottom housing are made of hard material.

Furthermore, a drainage hole is defined in the first bottom housing and/or the second bottom housing, and a rubber plug for sealing the drainage hole is provided on the first bottom housing and/or the second bottom housing.

Furthermore, a supporting strip is provided at a bottom portion of one or more of the first bottom housing, the second bottom housing, and the second folding part.

Furthermore, a plurality of folding marks are provided on the annular side wall, and the annular side wall can be folded along a height direction of the foldable bathtub through the folding marks.

Furthermore, the folding marks include a first folding mark and a second folding mark. The first folding mark and the second folding mark are spaced apart, and a length and a width of the annular side wall both gradually decrease in a direction away from the first bathtub edge.

The present invention has the following beneficial effects. Compared with the prior art, in the present invention, by configuring the annular side wall, the first folding part, and the second folding part to be made of flexible material, the annular side wall can be folded along the height direction of the foldable bathtub, and can be folded in half along a lengthwise direction of the foldable bathtub, so that the first bathtub edge and the second bathtub edge are in a top-to-bottom overlapping state when stored, thereby allowing the foldable bathtub to be folded twice, effectively reducing the volume of the foldable bathtub when in a storage state, and facilitating the user to carry outside. In addition, in this embodiment, the supporting member is slidably provided on the first bathtub edge and/or the second bathtub edge, and the supporting member does not affect the folding of the foldable bathtub when the foldable bathtub is in the storage state. When the foldable bathtub is opened, the supporting member can be used for the first folding part by moving the supporting member, so as to prevent the first folding part from collapsing downward under the action of gravity and affecting the usability of the bathtub.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
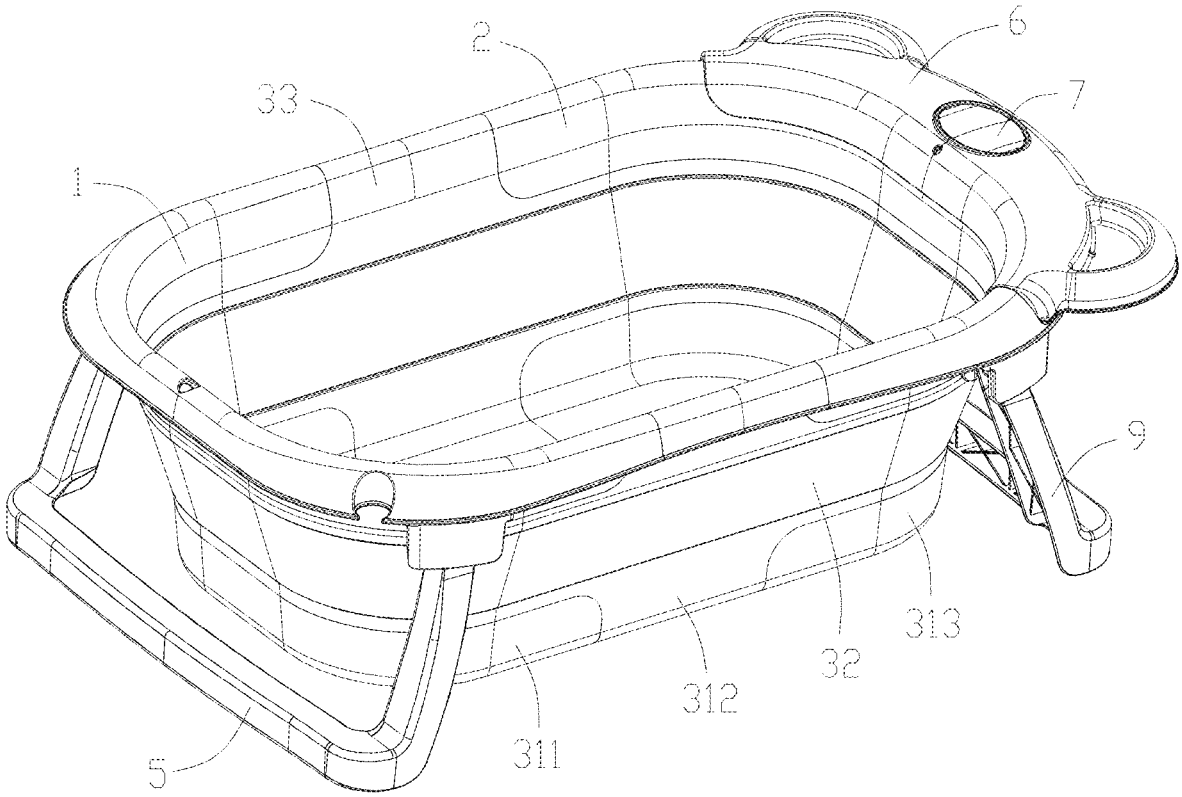
FIG. 1 is a perspective view of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
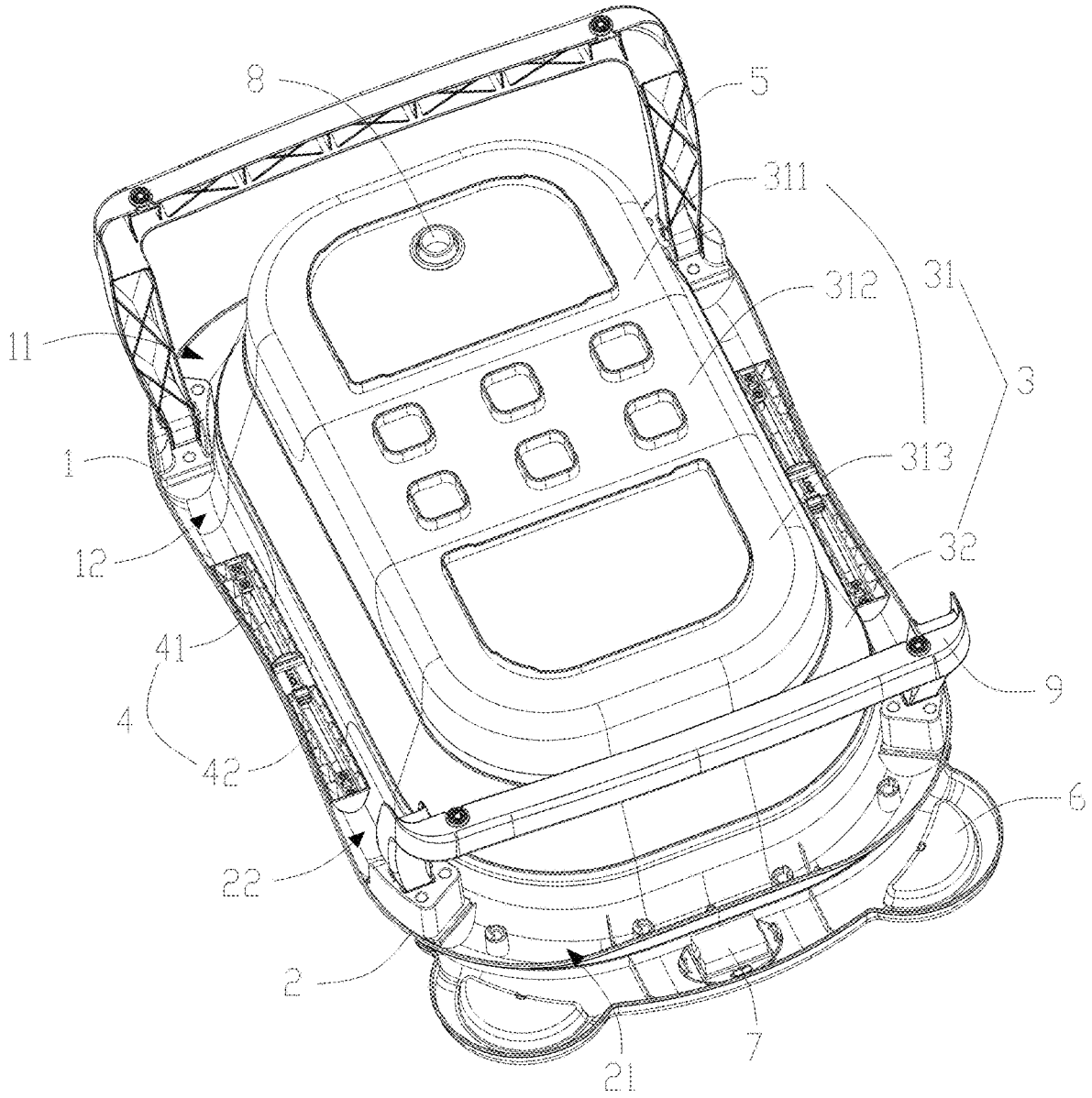
FIG. 2 is a schematic diagram of the present invention when a supporting member is supported on a first folding part.
Figure 3:
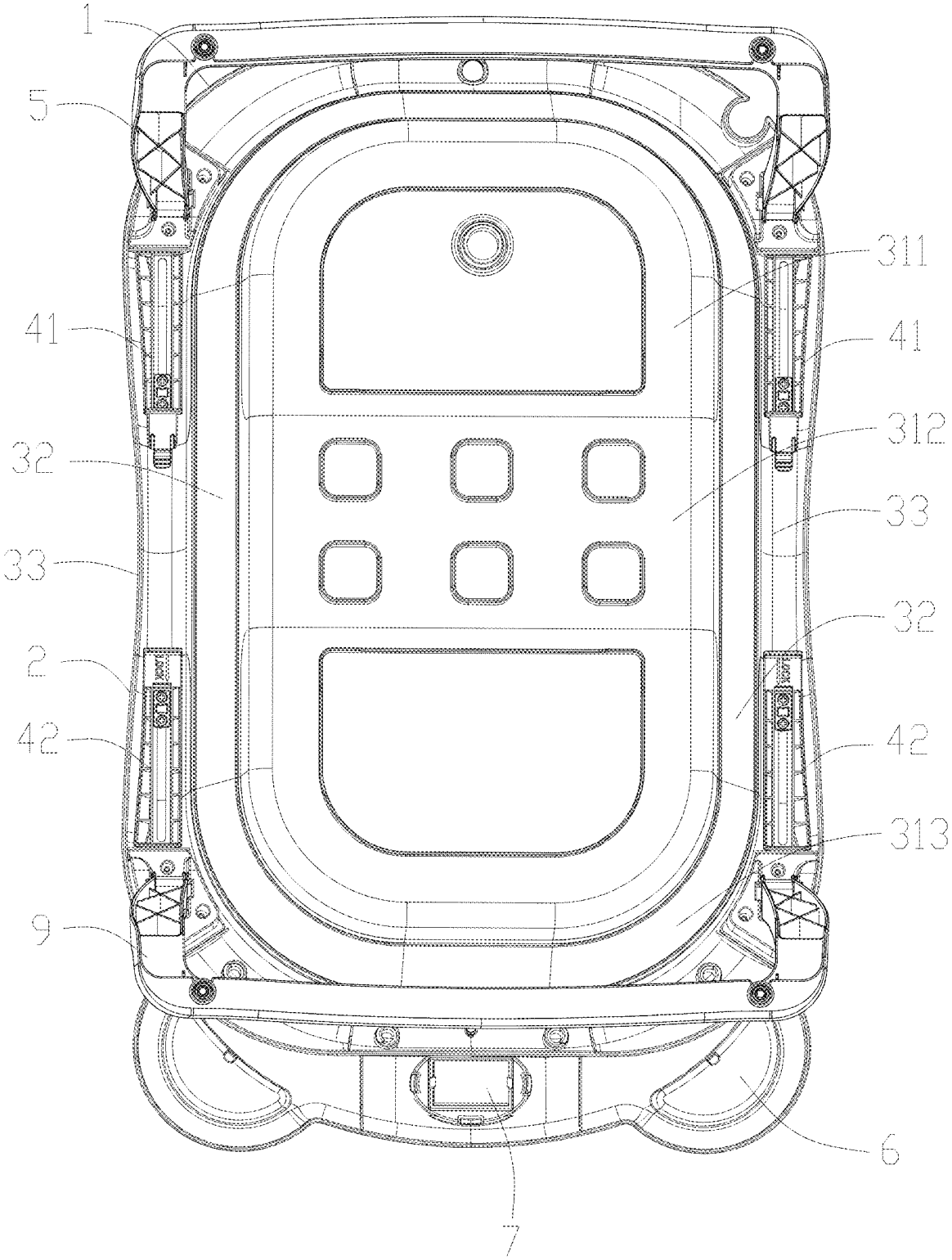
FIG. 3 is a schematic diagram of the present invention when a supporting member is not supported on a first folding part.
Figure 4:
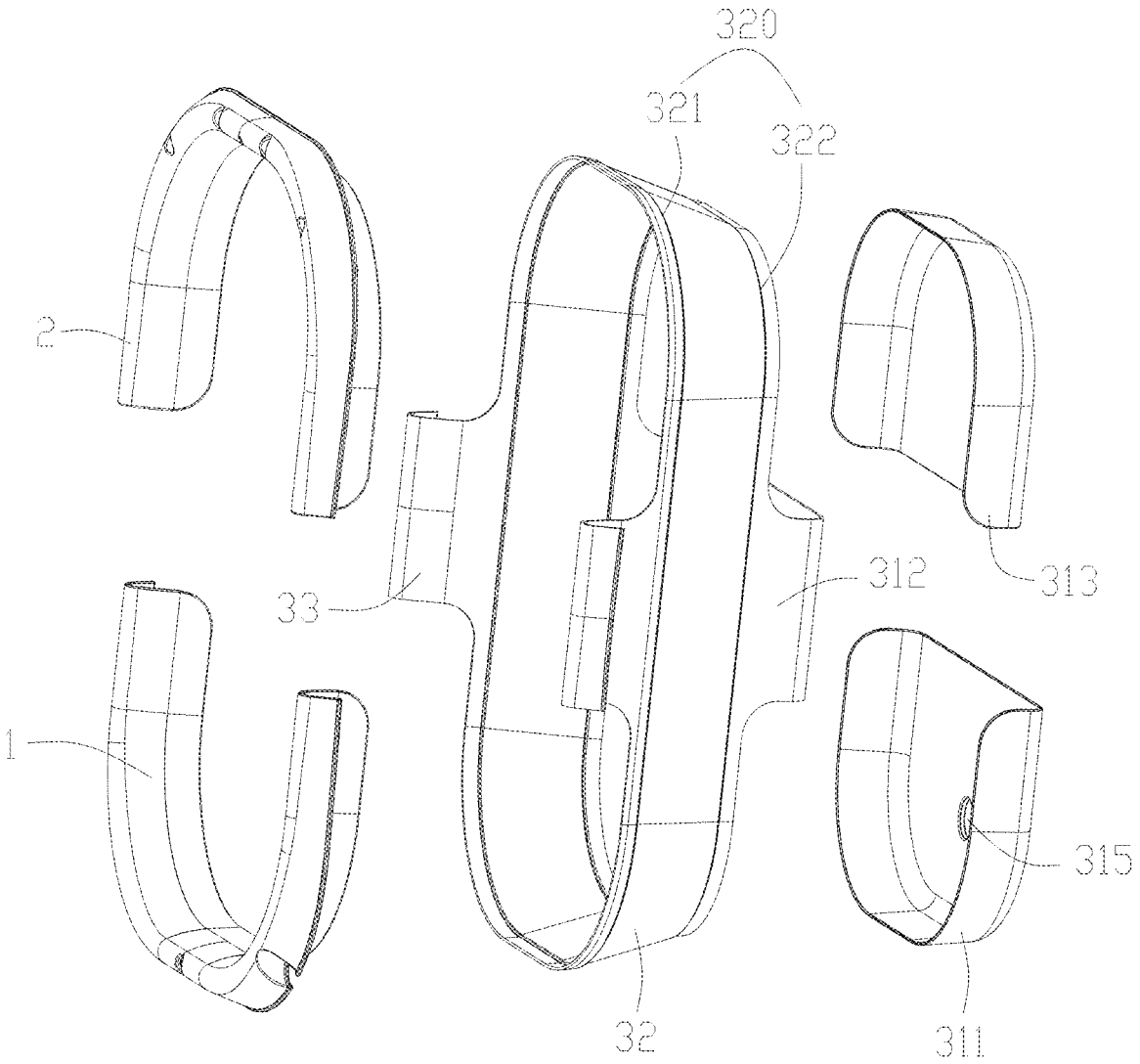
FIG. 4 is an exploded view of a first bathtub edge, a second bathtub edge, and a bathtub body of the present invention.
Figure 5:
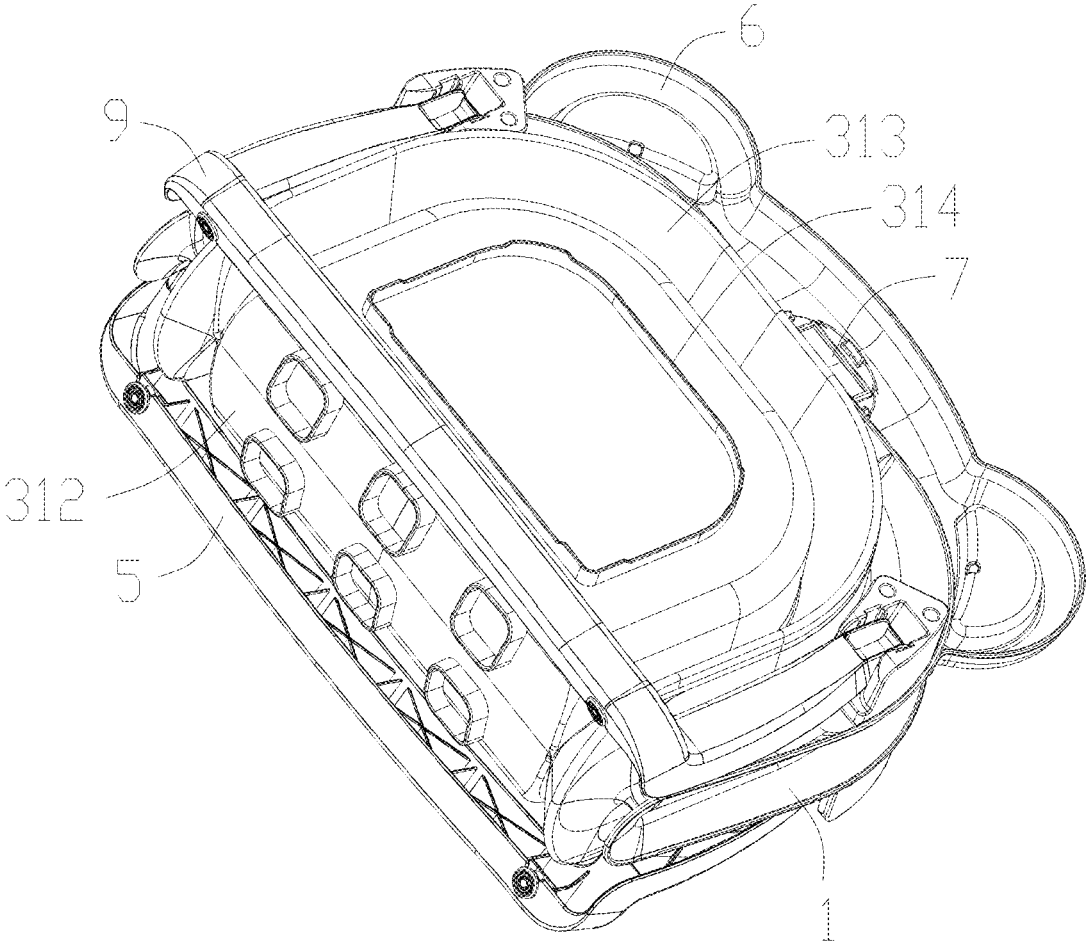
FIG. 5 is a schematic diagram of the present invention in a folded state.
Figure 6:
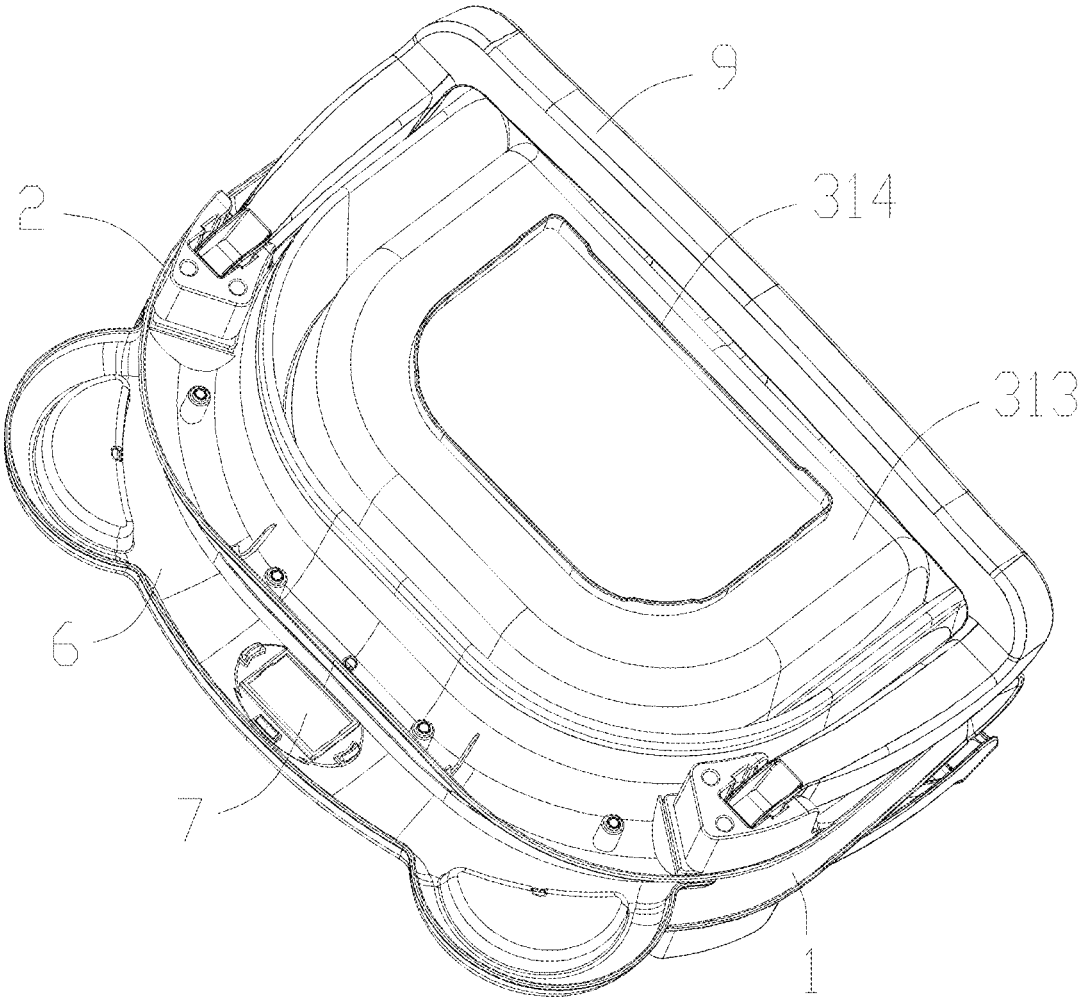
FIG. 6 is a schematic diagram of the present invention in a folded state from another angle of view.
Figure 7:
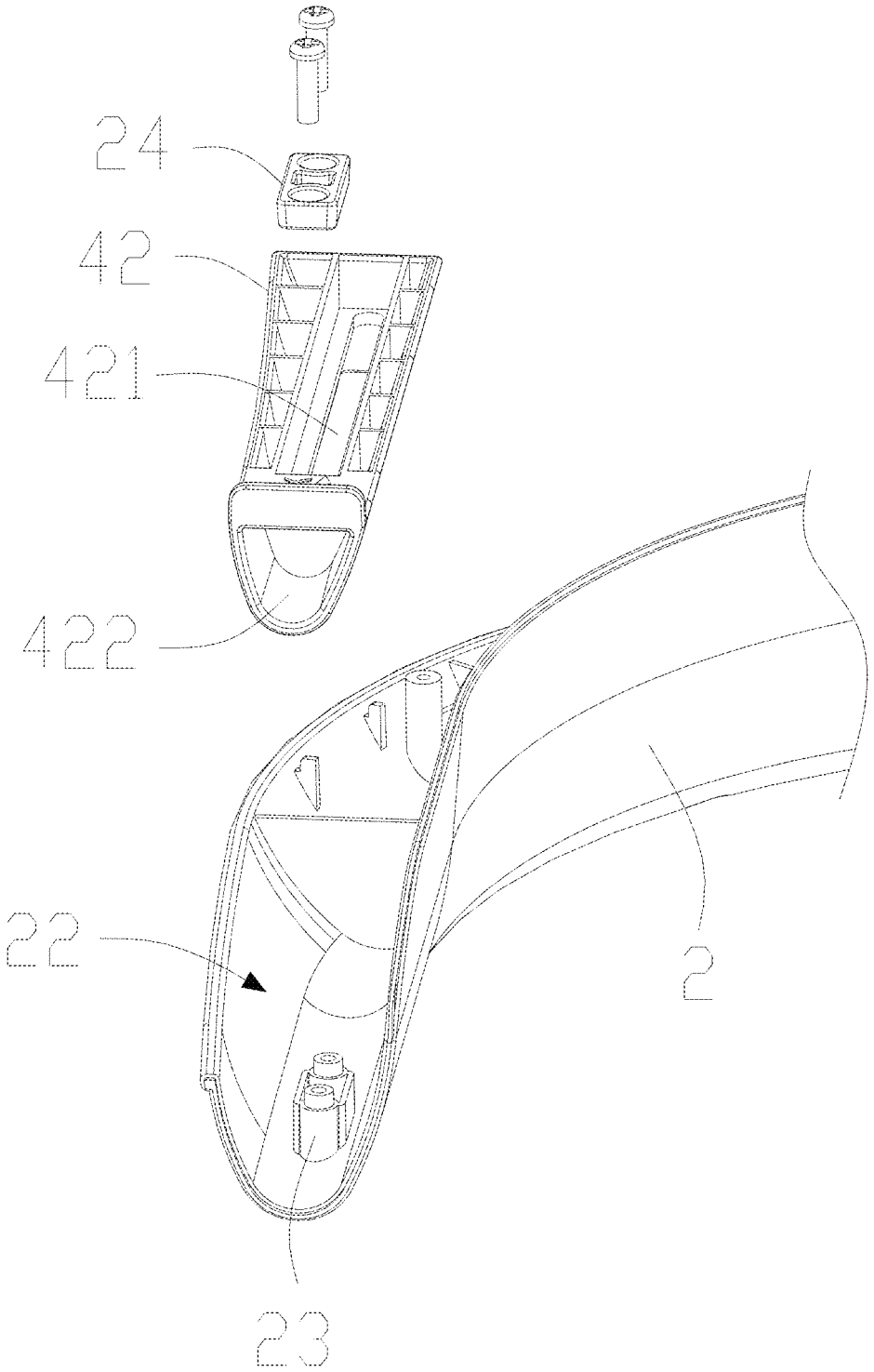
FIG. 7 is an exploded view of a second sliding member, a second position limiting block, and a second bathtub edge of the present invention.
Figure 8:
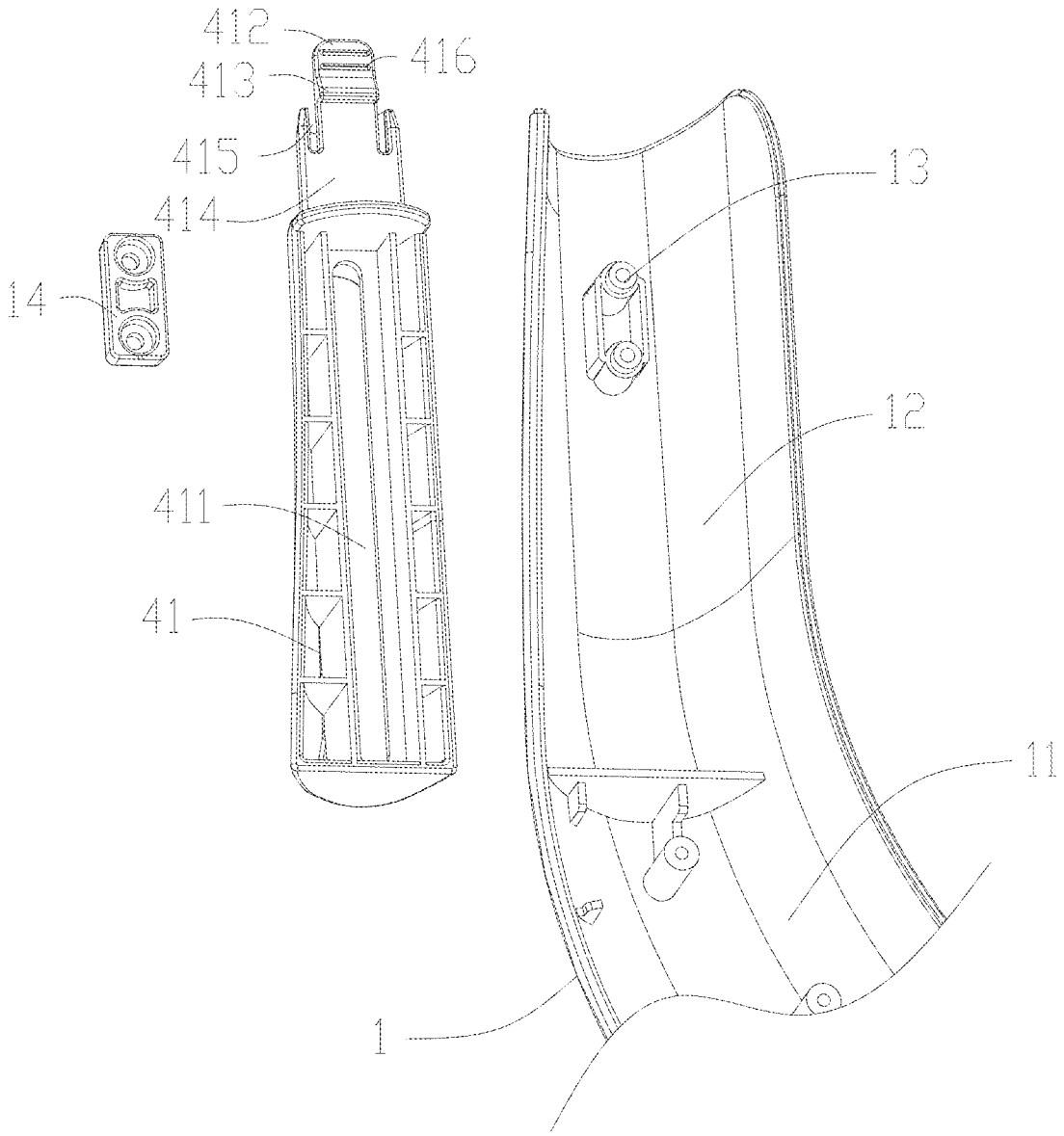
FIG. 8 is an exploded view of a first sliding member, a first position limiting block, and a first bathtub edge of the present invention.
Figure 9:
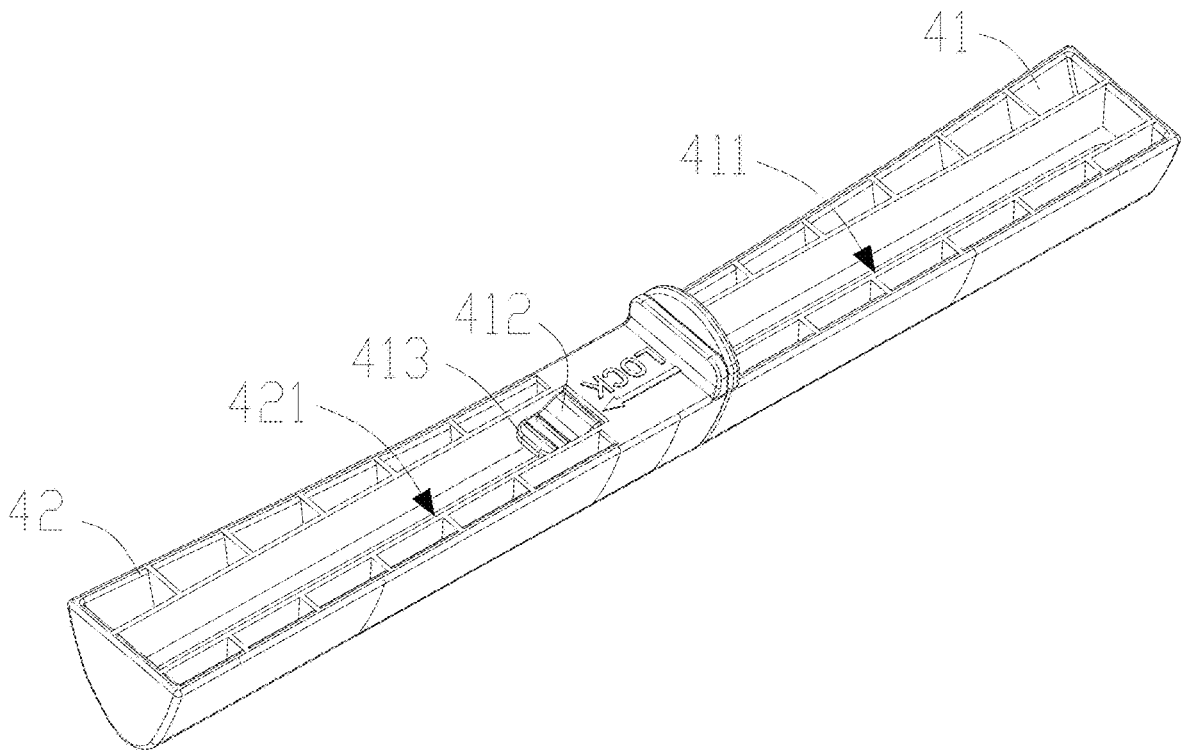
FIG. 9 is a schematic diagram of the connection between a first sliding member and a second sliding member of the present invention.
Figure 10:
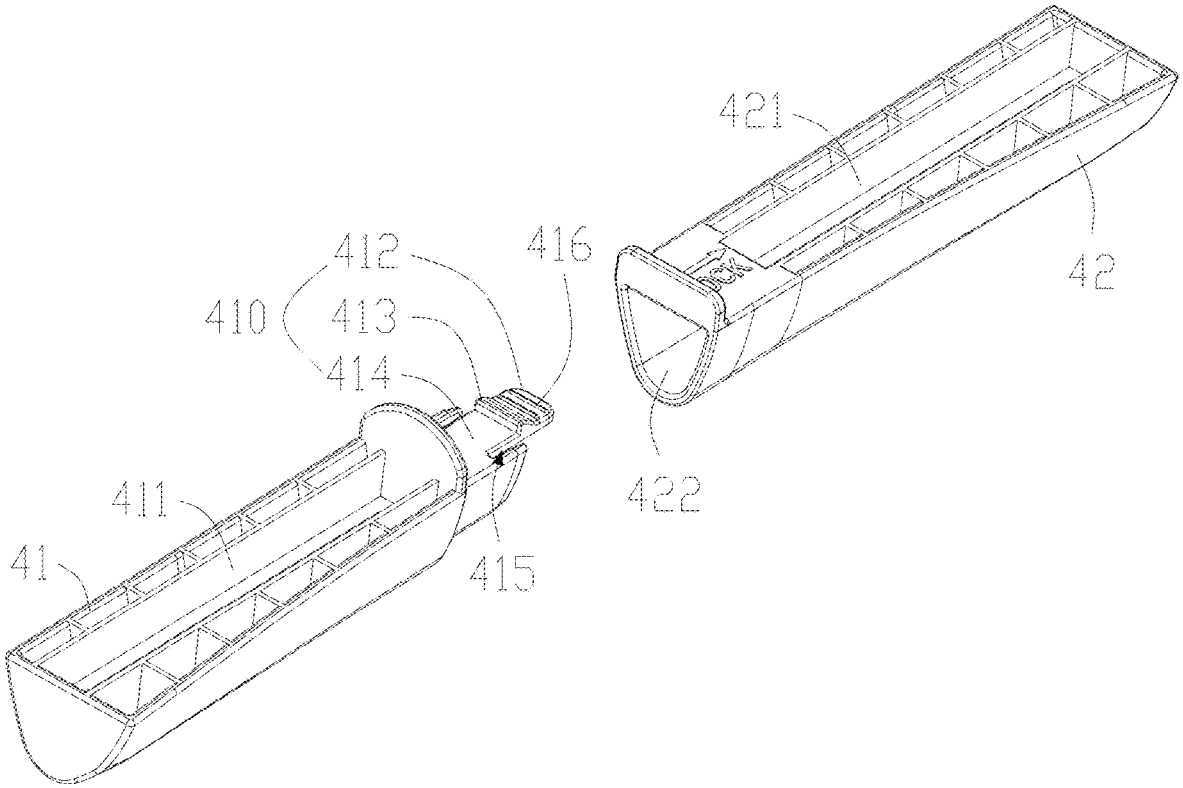
FIG. 10 is an exploded view of a first sliding member and a second sliding member of the present invention.
Figure 11:
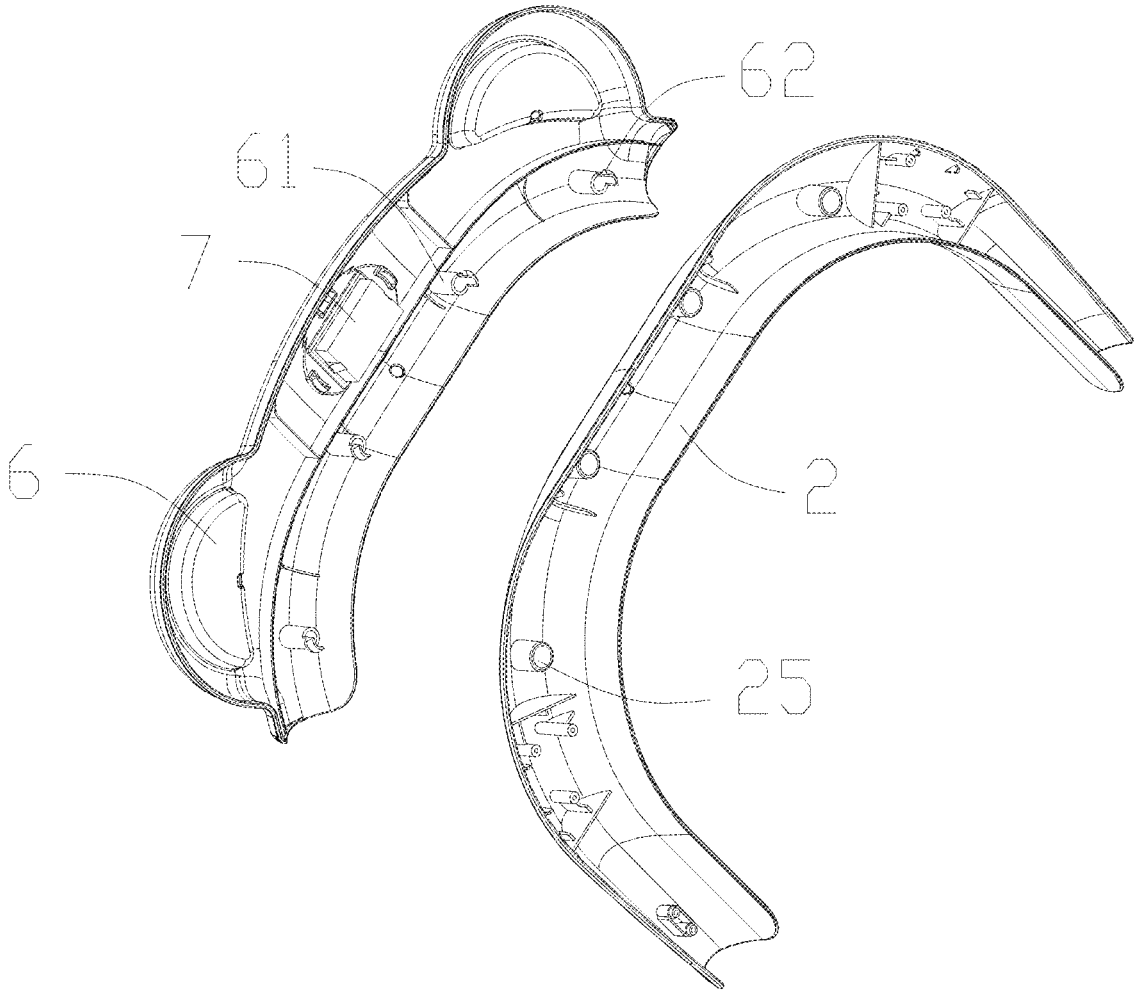
FIG. 11 is an exploded view of a second bathtub edge and a decorative outer housing of the present invention.

Referring to FIGS. 1-11, a foldable bathtub is provided in an embodiment of the present invention.

The foldable bathtub includes a first bathtub edge 1, a second bathtub edge 2, a bathtub body 3, and a supporting member 4. The bathtub body 3 includes an annular side wall 32 and a bathtub bottom 31. The bathtub bottom 31 is arranged at a bottom portion of the annular side wall 32. The first bathtub edge 1 and the second bathtub edge 2 are both arranged at a top portion of the annular side wall 32. The bathtub body 3 also includes a first folding part 33. Two side of the first folding part 33 are respectively connected to the first bathtub edge 1 and the second bathtub edge 2. The first folding part 33 is positioned at the top portion of the annular side wall 32, and the bathtub bottom 31 includes a second folding part 312. The annular side wall 32, the first folding part 33, and the second folding part 312 are made of flexible material. The first bathtub edge 1 is configured to be rotationally folded with the second bathtub edge 2 through the first folding part 33, and the bathtub bottom 31 is configured to be rotationally folded in half through the second folding part 312 and drive the annular side wall 32 to fold in half. The supporting member 4 is slidably provided on the first bathtub edge 1 and/or the second bathtub edge 2. The supporting member 4 is configured for supporting the first folding part 33 from collapsing downward when the foldable bathtub is in a use state.

In this embodiment, by configuring the annular side wall 32, the first folding part 33, and the second folding part 312 to be made of flexible material, the annular side wall 32 can be folded along a height direction of the foldable bathtub, and can be folded in half along a lengthwise direction of the foldable bathtub, so that the first bathtub edge 1 and the second bathtub edge 2 are in a top-to-bottom overlapping state when stored, thereby allowing the foldable bathtub to be folded twice, effectively reducing a volume of the foldable bathtub when in a storage state, and facilitating a user to carry outside. In addition, in this embodiment, the supporting member 4 is slidably provided on the first bathtub edge 1 and/or the second bathtub edge 2, and the supporting member 4 does not affect the folding of the foldable bathtub when the foldable bathtub is in the storage state. When the foldable bathtub is opened, the supporting member 4 can be used for the first folding part 33 by moving the supporting member 4, so as to prevent the first folding part 33 from collapsing downward under the action of gravity and affecting the usability of the bathtub.

In the above embodiment, a total number of the first folding parts 33 is two. The first folding parts 33 are arranged opposite to each other and are both positioned between the first bathtub edge 1 and the second bathtub edge 2.

In one embodiment, a total number of the supporting members 4 can be two, that is, each of the supporting members 4 is equipped with one first folding part 33 for use. A length of the supporting member 4 is greater than a length of the first folding part 33. When the foldable bathtub is in the use state, the supporting member 4 covers the first folding part 33, part of the supporting member 4 is positioned opposite to the first bathtub edge 1, and part of the supporting member 4 is positioned opposite to the second bathtub edge 2. That is, when the foldable bathtub is in the use state, a projection of the supporting member 4 passes through the first folding part 33, and two ends of the supporting member 4 are respectively arranged opposite to the first bathtub edge 1 and the second bathtub edge 2, so that the supporting member 4 can support the first folding part 33 when the foldable bathtub is in use.

In one embodiment, the supporting member 4 includes a first sliding member 41 and a second sliding member 42. The first sliding member 41 is slidably arranged on the first bathtub edge 1, and the second sliding member 42 is slidably arranged on the second bathtub edge 2. The first sliding member 41 abuts against or is connected to the second sliding member 42 when the foldable bathtub is in the use state, which can also prevent the supporting member 4 from supporting the first folding part 33 when the foldable bathtub is in use.

In one embodiment, the first sliding member 41 and the second sliding member 42 can be inserted into each other when the foldable bathtub is in the use state, achieving that the first folding part 33 does not collapse when the foldable bathtub is in use.

In one embodiment, the first sliding member 41 and the second sliding member 42 are connected in a buckle manner when the foldable bathtub is in the use state, which can also achieve that the first folding part 33 does not collapse when the foldable bathtub is in use.

In one embodiment, the first sliding member 41 is provided with a first fixing block 410 at one end close to the second sliding member 42, and the second sliding member 42 is provided with a first fixing opening 422 at one end close to the first sliding member 41. The first fixing block 410 is placed inside the first fixing opening 422 when the foldable bathtub is in the use state, thereby achieving the connection between the first sliding member 41 and the second sliding member 42.

In one embodiment, the first sliding member 41 is provided with gaps 415 on both sides of the first fixing block 410. By using the gaps 415, the first fixing block 410 can have elasticity, so that the first fixing block 410 can be engaged with or disengaged from the first fixing opening 422.

Specifically, the first fixing block 410 includes a connecting segment 414 connected to the first sliding member 41 and a first convex block 413 arranged on the connecting segment 414. The two gaps 415 are positioned on both sides of the connecting segment 414, and the connecting segment 414 is placed inside the first fixing opening 422. The first convex block 413 is engaged with a peripheral side of the first fixing opening 422, so that the first sliding member 41 and the second sliding member 42 are connected in a buckle manner.

In one embodiment, in order to facilitate the user to separate the first fixing block 410 and the first fixing opening 422, the connecting segment 414 extends at one end away from the first sliding member 41 to form an unlocking segment 412, and an anti-slip stripe 416 is provided on the unlocking segment 412.

In one embodiment, a first locking column 13 is provided on the first bathtub edge 1, and the foldable bathtub further includes a first position limiting block 14 provided on the first locking column 13. A first strip-shaped hole 411 is defined in the first sliding member 41, and the first sliding member 41 is positioned between the first position limiting block 14 and the first locking column 13. The first position limiting block 14 and/or the first locking column 13 are partially placed in the first strip-shaped hole 411, and a width of the first position limiting block 14 is greater than a width of the first strip-shaped hole 411 to achieve the sliding of the first sliding member 41 on the first bathtub edge 1.

The second bathtub edge 2 is equipped with a second locking column 23, and the foldable bathtub also includes a second position limiting block 24 arranged on the second locking column 23. A second strip-shaped hole 421 is defined in the second sliding member 42, and the second sliding member 42 is positioned between the second position limiting block 24 and the second locking column 23. The second position limiting block 24 and/or the second locking column 23 are partially placed in the second strip-shaped hole 421. A width of the second position limiting block 24 is greater than a width of the second strip-shaped hole 421 to achieve the sliding of the second sliding member 42 on the second bathtub edge 2.

In one embodiment, in order to allow the first sliding member 41 and the second sliding member 42 to slide stably and to make the structure of the foldable bathtub compact, the first bathtub edge 1 is bent outward to form a first position limiting groove 11. The first locking column 13 and the first position limiting block 14 are both placed in the first position limiting groove 11, and the first sliding member 41 is at least partially placed in the first position limiting groove 11. The second bathtub edge 2 is bent outward to form a second position limiting groove 21. The second locking column 23 and the second position limiting block 24 are both placed in the second position limiting groove 21, and the second sliding member 42 is at least partially placed in the second position limiting groove 21.

In one embodiment, in order to make the structure of the foldable bathtub more compact, the first position limiting groove 11 is provided with a first sliding groove 12 at a position corresponding to the first sliding member 41, and the second position limiting groove 21 is provided with a second sliding groove 22 at a position corresponding to the second sliding member 42. A width of the first sliding groove 12, a width of the second sliding groove 22, a width of the first sliding member 41, and a width of the second sliding member 42 all gradually increase in a direction away from the first folding part 33. With this structure, the user can smoothly slide the first sliding member 41 away from the first folding part 33 and the second sliding member 42 away from the first folding part 33 after the first fixing block 410 is detached from the first fixing opening 422.

In other embodiments, C-shaped grooves can be defined in both the first bathtub edge 1 and the second bathtub edge 2, and the first sliding member 41 and the second sliding member 42 are respectively inserted into the C-shaped grooves of the first bathtub edge 1 and the second bathtub edge 2, which can also achieve sliding of the first sliding member 41 on the first bathtub edge 1 and sliding of the second sliding member 42 on the second bathtub edge 2.

In one embodiment, the foldable bathtub further includes a temperature detection module 7 for detecting temperature. The temperature detection module 7 is arranged on the first bathtub edge 1 or the second bathtub edge 2. By using the temperature detection module 7, the user can know the temperature of the water inside the bathtub, detect the water temperature, and adjust the water temperature in a timely manner, making it convenient for the user to use.

In one embodiment, the foldable bathtub further includes a decorative outer housing 6. The decorative outer housing 6 is arranged on the first bathtub edge 1 and/or the second bathtub edge 2, and the temperature detection module 7 is arranged on the decorative outer housing 6. By using the decorative outer housing 6, the foldable bathtub can be made more beautiful, and the shape of the foldable bathtub can be diversified to meet the needs of the user. Moreover, when the foldable bathtub is used for infants or children, the decorative outer housing 6 can be used to attract the infants or the children.

In one embodiment, a plurality of first fixing holes 25 are defined in the first bathtub edge 1 and/or the second bathtub edge 2, and a plurality of connecting columns 61 are provided at a bottom portion of the decorative outer housing 6. The connecting columns 61 are provided with second convex blocks 62. The connecting columns 61 are placed inside the first fixing holes 25. The second convex blocks 62 are positioned below the first fixing holes 25 to achieve the engaging of the decorative outer housing 6 to the first bathtub edge 1 or the second bathtub edge 2. In this way, by additionally configuring different decorative outer housings 6, the production of other main bodies of the foldable bathtub will not be affected, thereby forming different shapes of foldable bathtubs and reducing the cost of mold making for different shapes of foldable bathtubs.

In one embodiment, the decorative outer housing 6 is arranged along a circumference of the first bathtub edge 1 or the second bathtub edge 2, and a width of the decorative outer housing 6 is greater than two-thirds of a width of the foldable bathtub. The temperature detection module 7 is arranged at a middle position in a width direction of the foldable bathtub to better shape the foldable bathtub through the decorative outer housing 6. For example, in this embodiment, the decorative outer housing 6 is in the shape of a bear, and the temperature detection module 7 is positioned at a position of the bear's nose to make the shape of the bear more vivid. Of course, manufacturers can also make the decorative outer housing 6 into shapes such as crocodiles, crabs, yellow ducks, frogs, piglets, rabbits, beach scenes, dream scenes, etc.

In one embodiment, the foldable bathtub further includes a first supporting leg 5 rotatably arranged on the first bathtub edge 1, and the first supporting leg 5 is positioned on one side of the first sliding member 41 away from the second sliding member 42. The foldable bathtub further includes a second supporting leg 9 rotatably arranged on the second bathtub edge 2. The second supporting leg 9 is positioned on one side of the second sliding member 42 away from the first sliding member 41. In this way, when the foldable bathtub is in the storage state, the first supporting leg 5 and the second supporting leg 9 can be folded and stored. When the foldable bathtub is in the use state, the first supporting leg 5 and the second supporting leg 9 can be opened to jointly support the foldable bathtub. A bottom portion of the first supporting leg 5 and a bottom portion of the second supporting leg 9 are both positioned below a bottom portion of the bathtub bottom 31 or on an identical plane with the bottom portion of the bathtub bottom 31 when the foldable bathtub is in the use state, so that the bathtub body 3 can be fully unfolded in the use state, thereby preventing the first supporting leg 5 and the second supporting leg 9 from being too short and affecting the unfolding of the bathtub body 3 when in the use state.

In one embodiment, the bathtub bottom 31 further includes a first bottom housing 311 and a second bottom housing 313 both arranged at the bottom portion of the annular side wall 32. The second folding part 312 is positioned between the first bottom housing 311 and the second bottom housing 313, and two sides of the second folding part 312 are respectively connected to the first bottom housing 311 and the second bottom housing 313. The first bottom housing 311 and the second bottom housing 313 are made of hard material, which can improve the strength of the foldable bathtub, allow the bathtub bottom 31 to have a fixed shape, and prevent the bathtub body 3 from collapsing downward under the gravity of water to affect use.

In one embodiment, a drainage hole 315 is defined in the first bottom housing 311 and/or the second bottom housing 313, and a rubber plug 8 for sealing the drainage hole 315 is provided on the first bottom housing 311 and/or the second bottom housing 313. The drainage hole 315 is used to allow the user to drain the foldable bathtub, and when the foldable bathtub is in use, the rubber plug 8 is fixed on the drainage hole 315 to prevent water leakage.

In one embodiment, a supporting strip 314 is provided at a bottom portion of one or more of the first bottom housing 311, the second bottom housing 313, and the second folding part 312. By using the supporting strip 314, when the foldable bathtub is in use, the bathtub bottom 31 can be placed on a placement surface to provide support for the bathtub bottom 31.

In one embodiment, a plurality of folding marks 320 are provided on the annular side wall, and the annular side wall can be easily folded along the height direction of the foldable bathtub through the folding marks 320 to reduce the volume of the foldable bathtub.

Specifically, in this embodiment, the folding marks 320 include a first folding mark 321 and a second folding mark 322. The first folding mark 321 and the second folding mark 322 are spaced apart, and a length and a width of the annular side wall 32 both gradually decrease in a direction away from the first bathtub edge 1. In this way, by folding the annular side wall through the first folding mark 321 and the second folding mark 322, the bathtub bottom 31 can be positioned between the first bathtub edge 1 and the second bathtub edge 2. Of course, in other embodiments, a total number of the folding marks 320 can be one, three, etc., and the manufacturer can configure the number according to the volume of the foldable bathtub after folding.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A foldable bathtub, comprising a first bathtub edge, a second bathtub edge, a bathtub body, and a supporting member;

wherein the bathtub body comprises an annular side wall and a bathtub bottom, the bathtub bottom is arranged at a bottom portion of the annular side wall, the first bathtub edge and the second bathtub edge are both arranged at a top portion of the annular side wall, the bathtub body also comprises a first folding part, two side of the first folding part are respectively connected to the first bathtub edge and the second bathtub edge, the first folding part is positioned at the top portion of the annular side wall, and the bathtub bottom comprises a second folding part; the annular side wall, the first folding part, and the second folding part are made of flexible material; the first bathtub edge is configured to be rotationally folded with the second bathtub edge through the first folding part, and the bathtub bottom is configured to be rotationally folded in half through the second folding part and drive the annular side wall to fold in half;

the supporting member is slidably provided on the first bathtub edge and/or the second bathtub edge, and the supporting member is configured for supporting the first folding part from collapsing downward when the foldable bathtub is in a use state.

2. The foldable bathtub according to claim 1, wherein the supporting member comprises a first sliding member and a second sliding member, the first sliding member is slidably arranged on the first bathtub edge, the second sliding member is slidably arranged on the second bathtub edge, and the first sliding member abuts against or is connected to the second sliding member when the foldable bathtub is in the use state.

3. The foldable bathtub according to claim 2, wherein the first sliding member and the second sliding member are connected in a buckle manner when the foldable bathtub is in the use state.

4. The foldable bathtub according to claim 3, wherein the first sliding member is provided with a first fixing block at one end close to the second sliding member, the second sliding member is provided with a first fixing opening at one end close to the first sliding member, and the first fixing block is placed inside the first fixing opening when the foldable bathtub is in the use state.

5. The foldable bathtub according to claim 4, wherein the first sliding member is provided with gaps on both sides of the first fixing block.

6. The foldable bathtub according to claim 5, wherein the first fixing block comprises a connecting segment connected to the first sliding member and a first convex block arranged on the connecting segment, and the two gaps are positioned on both sides of the connecting segment.

7. The foldable bathtub according to claim 6, wherein the connecting segment extends at one end away from the first sliding member to form an unlocking segment, and an anti-slip stripe is provided on the unlocking segment.

8. The foldable bathtub according to claim 2, wherein a first locking column is provided on the first bathtub edge, the foldable bathtub further comprises a first position limiting block provided on the first locking column, a first strip-shaped hole is defined in the first sliding member, the first sliding member is positioned between the first position limiting block and the first locking column, the first position limiting block and/or the first locking column are partially placed in the first strip-shaped hole, and a width of the first position limiting block is greater than a width of the first strip-shaped hole;

the second bathtub edge is equipped with a second locking column, the foldable bathtub also comprises a second position limiting block arranged on the second locking column, a second strip-shaped hole is defined in the second sliding member, the second sliding member is positioned between the second position limiting block and the second locking column, the second position limiting block and/or the second locking column are partially placed in the second strip-shaped hole, and a width of the second position limiting block is greater than a width of the second strip-shaped hole.

9. The foldable bathtub according to claim 8, wherein the first bathtub edge is bent outward to form a first position limiting groove, the first locking column and the first position limiting block are both placed in the first position limiting groove, and the first sliding member is at least partially placed in the first position limiting groove; the second bathtub edge is bent outward to form a second position limiting groove, the second locking column and the second position limiting block are both placed in the second position limiting groove, and the second sliding member is at least partially placed in the second position limiting groove.

10. The foldable bathtub according to claim 9, wherein the first position limiting groove is provided with a first sliding groove at a position corresponding to the first sliding member, and the second position limiting groove is provided with a second sliding groove at a position corresponding to the second sliding member; a width of the first sliding groove, a width of the second sliding groove, a width of the first sliding member, and a width of the second sliding member all gradually increase in a direction away from the first folding part.

11. The foldable bathtub according to claim 1, wherein the foldable bathtub further comprises a temperature detection module for detecting temperature, and the temperature detection module is arranged on the first bathtub edge or the second bathtub edge.

12. The foldable bathtub according to claim 11, wherein the foldable bathtub further comprises a decorative outer housing, the decorative outer housing is arranged on the first bathtub edge and/or the second bathtub edge, and the temperature detection module is arranged on the decorative outer housing.

13. The foldable bathtub according to claim 12, wherein a plurality of first fixing holes are defined in the first bathtub edge and/or the second bathtub edge, a plurality of connecting columns are provided at a bottom portion of the decorative outer housing, the connecting columns are provided with second convex blocks, the connecting columns are placed inside the first fixing holes, and the second convex blocks are positioned below the first fixing holes.

14. The foldable bathtub according to claim 13, wherein the decorative outer housing is arranged along the first bathtub edge or the second bathtub edge, a width of the decorative outer housing is greater than two-thirds of a width of the foldable bathtub, and the temperature detection module is arranged at a middle position in a width direction of the foldable bathtub.

15. The foldable bathtub according to claim 2, wherein the foldable bathtub further comprises a first supporting leg rotatably arranged on the first bathtub edge, and the first supporting leg is positioned on one side of the first sliding member away from the second sliding member; the foldable bathtub further comprises a second supporting leg rotatably arranged on the second bathtub edge, the second supporting leg is positioned on one side of the second sliding member away from the first sliding member, a bottom portion of the first supporting leg and a bottom portion of the second supporting leg are both positioned below a bottom portion of the bathtub bottom or on an identical plane with the bottom portion of the bathtub bottom when the foldable bathtub is in the use state.

16. The foldable bathtub according to claim 1, wherein the bathtub bottom further comprises a first bottom housing and a second bottom housing both arranged at the bottom portion of the annular side wall, the second folding part is positioned between the first bottom housing and the second bottom housing, two sides of the second folding part are respectively connected to the first bottom housing and the second bottom housing, and the first bottom housing and the second bottom housing are made of hard material.

17. The foldable bathtub according to claim 16, wherein a drainage hole is defined in the first bottom housing and/or the second bottom housing, and a rubber plug for sealing the drainage hole is provided on the first bottom housing and/or the second bottom housing.

18. The foldable bathtub according to claim 16, wherein a supporting strip is provided at a bottom portion of one or more of the first bottom housing, the second bottom housing, and the second folding part.

19. The foldable bathtub according to claim 1, wherein a plurality of folding marks are provided on the annular side wall, and the annular side wall can be folded along a height direction of the foldable bathtub through the folding marks.

20. The foldable bathtub according to claim 19, wherein the folding marks comprise a first folding mark and a second folding mark, the first folding mark and the second folding mark are spaced apart, and a length and a width of the annular side wall both gradually decrease in a direction away from the first bathtub edge.

* * * * *